US007360497B2

(12) United States Patent
Marcangelo et al.

(10) Patent No.: US 7,360,497 B2
(45) Date of Patent: Apr. 22, 2008

(54) BIASING MECHANISM FOR SEWING MACHINE PRESSER FOOT

(75) Inventors: Steven Marcangelo, North Chelmsford, MA (US); John L. Sigouin, Newton, NH (US)

(73) Assignee: L & P Property Management Company, South Gate, CA (US)

( * ) Notice: Subject to any disclaimer, the term of this patent is extended or adjusted under 35 U.S.C. 154(b) by 488 days.

(21) Appl. No.: 10/841,501

(22) Filed: May 10, 2004

(65) Prior Publication Data

US 2005/0039658 A1 Feb. 24, 2005

Related U.S. Application Data

(60) Provisional application No. 60/472,351, filed on May 21, 2003.

(51) Int. Cl.
*D05B 29/00* (2006.01)
*D05B 29/08* (2006.01)

(52) U.S. Cl. ..... 112/235

(58) Field of Classification Search ..... 112/60, 112/61, 235, 237, 238, 239, 320
See application file for complete search history.

(56) References Cited

U.S. PATENT DOCUMENTS

| | | | | |
|---|---|---|---|---|
| 2,419,494 | A * | 4/1947 | Knaus | 112/235 |
| 3,437,062 | A * | 4/1969 | Hacklander | 112/320 |
| 4,285,289 | A | 8/1981 | Bolldorf et al. | 112/98 |
| 4,323,020 | A * | 4/1982 | Thompson | 112/61 |
| 4,449,464 | A | 5/1984 | Porter | 27/6 |
| 4,706,587 | A | 11/1987 | Shiomi | 112/237 |
| 5,309,854 | A | 5/1994 | Mulcahey et al. | 27/4 |
| 6,164,225 | A * | 12/2000 | Murata et al. | 112/237 |

FOREIGN PATENT DOCUMENTS

JP 362152498 A * 7/1987

* cited by examiner

*Primary Examiner*—Ismael Izaguirre
(74) *Attorney, Agent, or Firm*—Wood, Herron & Evans, L.L.P.

(57) ABSTRACT

A sewing machine comprises a presser foot; a drive shaft operably connected to the presser foot which imparts periodic upward movement to the presser foot; and a biasing mechanism operably connected to the presser foot which normally biases the presser foot into a downward position, the biasing mechanism comprising a toggle link having a pivot, a resilient element operably connected to the toggle link on one side of the pivot and the presser foot operably connected to the toggle link on the other side of the pivot.

8 Claims, 3 Drawing Sheets

BIASING MECHANISM FOR SEWING MACHINE PRESSER FOOT

RELATED APPLICATION

This application is a continuation and claims the benefit of U.S. Provisional Patent Application Ser. No. 60/472,351 filed May 21, 2003.

FIELD OF THE INVENTION

This invention relates generally to sewing machines, and more particularly to biasing mechanisms for the presser feet of industrial sewing machines.

BACKGROUND OF THE INVENTION

Industrial sewing machines of the type disclosed in U.S. Pat. Nos. 4,449,464 and 5,309,854, both of which are hereby incorporated by reference herein, employ a biasing mechanism to normally bias the presser foot into a downward position against the periodic upward movement imparted to the presser foot by the reciprocating drive shaft. This biasing mechanism has heretofore been comprised of one or more helical compression springs encircling the presser foot lifting bar and contained within or by a cylindrical tube or guide rod.

Industrial sewing machines of the so-called "high lift" variety utilize such compression springs and are typically limited to operational speeds of about 3000 revolutions per minute. To achieve greater operational speeds more spring preload is required. However, more spring preload results in greater "wear and tear" on the sewing machine, the result being likely failure of a sewing machine component during sewing operations involving stitching over seams.

It is desirable to increase the operating speed of industrial sewing machines above 3000 revolutions per minute in order to increase productivity, but without jeopardizing the structural integrity of the sewing machine's components.

SUMMARY OF THE INVENTION

In one aspect the present invention is a sewing machine comprising a presser foot; a drive shaft operably connected to the presser foot which imparts periodic upward movement to the presser foot; and a biasing mechanism operably connected to the presser foot which normally biases the presser foot into a downward position, the biasing mechanism comprising a toggle link having a pivot, a resilient element operably connected to the toggle link on one side of the pivot and the presser foot operably connected to the toggle link on the other side of the pivot.

The resilient member can be a compression spring. The sewing machine can further comprise a presser foot lifting bar, the presser foot operably connected to the presser foot lifting bar; a mounting plate; the toggle link operably pivoted relative to the mounting plate; the resilient element operably fixed relative to the mounting plate; the toggle link operably connected to the presser foot lifting bar. The sewing machine can further comprise a support plate, the toggle link pivoted to the support plate and the resilient element fixed to the support plate; the support plate pivoted to the mounting plate; whereby pivoting the support plate relative to the mounting plate pivots the toggle link and resilient element out of biasing engagement with the presser foot lifting bar. The sewing machine can further comprise a motion generating device operably connected between the support plate and the mounting plate for pivoting the support plate, toggle link and resilient element into and out of biasing engagement with the presser foot lifting bar. The motion generating device can be a pneumatic cylinder.

In another aspect the present invention is a sewing machine comprising a presser foot; a drive shaft operably connected to the presser foot which imparts periodic upward movement to the presser foot; and a biasing mechanism operably connected to the presser foot which normally biases the presser foot into a downward position, the biasing mechanism having a preload force therein when the presser foot is in a lowermost position; the presser foot being selectively raisable without increasing the preload force of the biasing mechanism.

The biasing mechanism can be selectively movable into and out of biasing engagement with the presser foot thereby preventing any increase in the biasing mechanism preload force during selective raising of the pressure foot. The biasing mechanism can be selectively pivotable into and out of biasing engagement with the presser foot thereby preventing any increase in the biasing mechanism preload force during selective raising of the pressure foot. The biasing mechanism can comprise a compression spring; and a toggle link; the compression spring operably connected to one end of the toggle link, the presser foot operably connected to the other end of the toggle link. The sewing machine can further comprise a mounting plate; a support plate pivoted to the mounting plate; the compression spring fixed to the support plate; the toggle link pivoted to the support plate. The sewing machine can further comprise a presser foot lifting bar, the presser foot connected to one end of the presser foot lifting bar, the toggle link connected to the other end of the presser foot lifting bar.

These and other features and advantages of the present invention will become more readily apparent during the following detailed description taken in conjunction with the drawings herein, in which:

BRIEF DESCRIPTION OF THE DRAWINGS OF THE INVENTION

DETAILED DESCRIPTION OF A PREFERRED EMBODIMENT OF THE INVENTION

Figure 1:
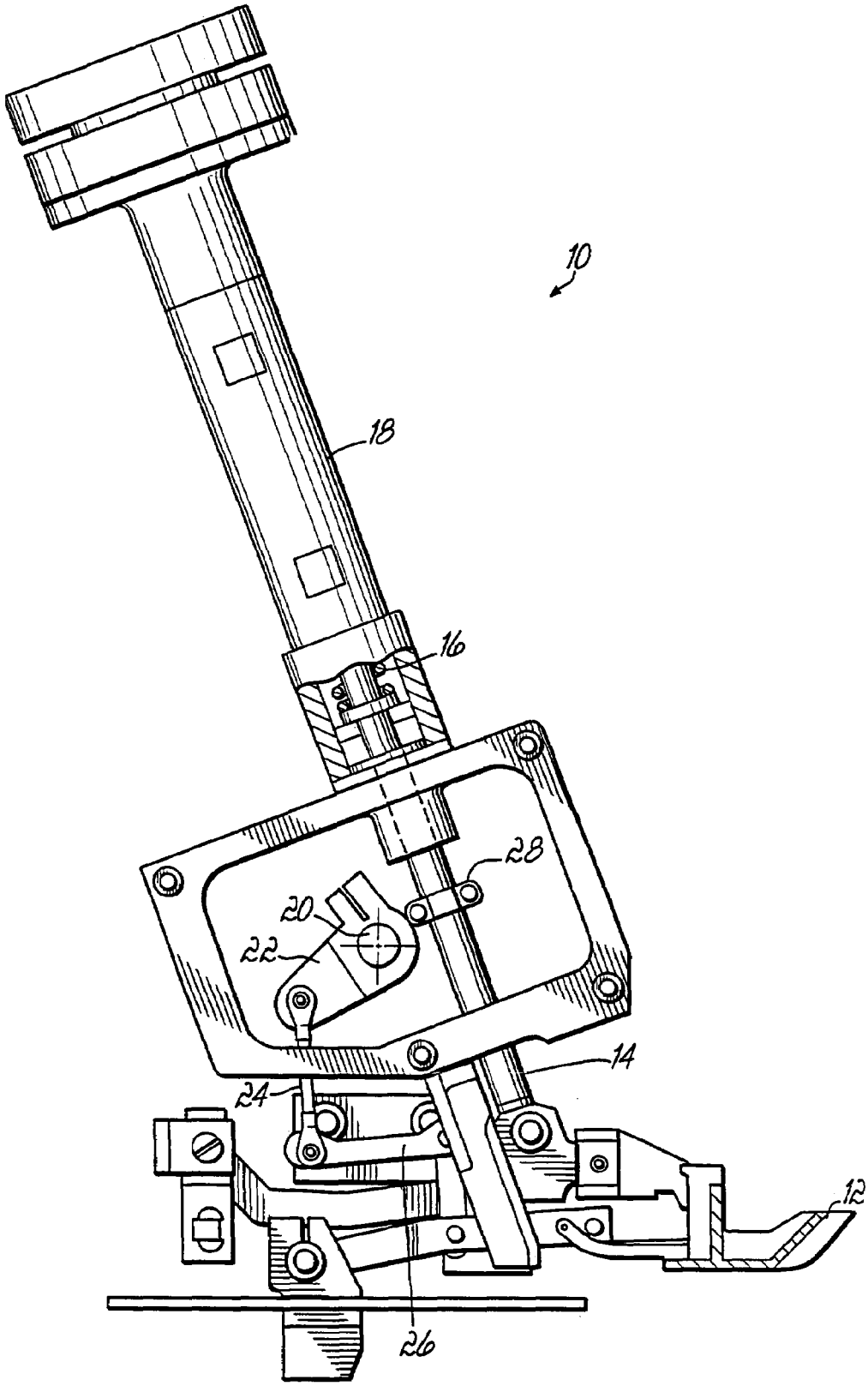
PRIOR ART FIG. 1
FIG. 1 is a side view of a sewing machine including the prior art presser foot biasing mechanism.

Referring first to FIG. 1 there is illustrated a sewing machine 10 of the prior art. Sewing machine 10 includes a presser foot 12 connected to an end of a presser foot lifting bar 14. Presser foot 12 is normally biased towards a down position via a compression spring 16 encircling presser foot. lifting bar 14 and contained within a compression spring housing 18. During sewing periodic upward movement against the bias of spring 16 is imparted to presser foot 12 via a crank shaft 20, crank link 22 and connecting links 24, 26. A hydraulic or pneumatic cylinder (not shown) can be connected to collar 28 on presser foot lifting bar 14 and manually operated to raise the presser foot 12.

Figure 2:
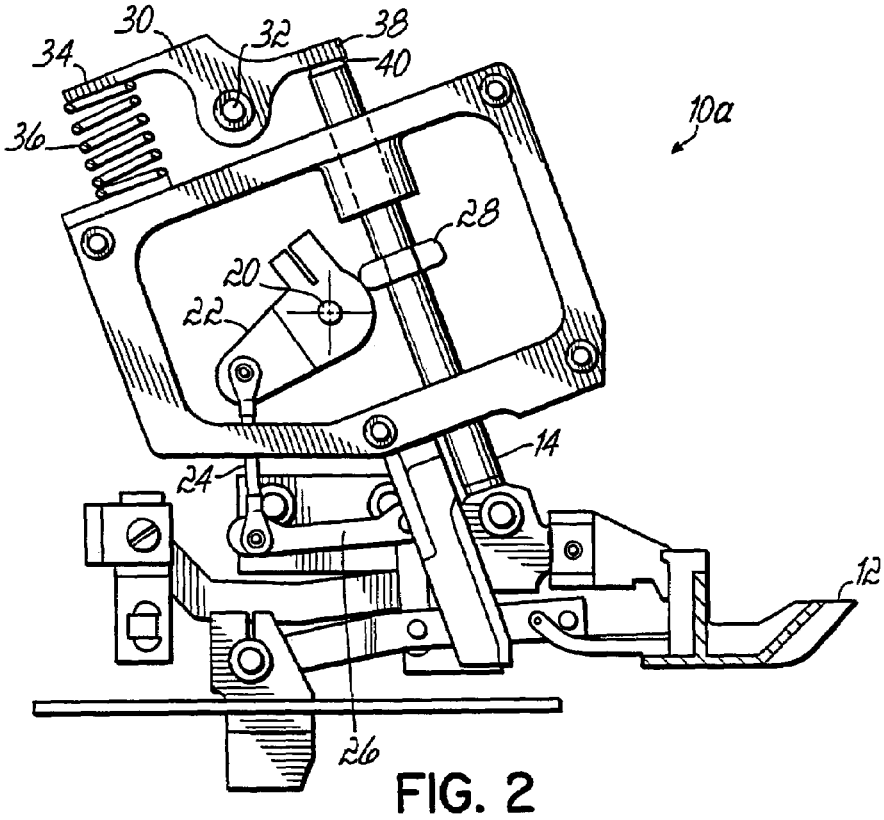
FIG. 2 is a side view of a sewing machine including the presser foot biasing mechanism of the present invention.

Referring now to FIG. 2, and with like numbers designating like elements, there is illustrated a sewing machine 10*a* including the presser foot biasing mechanism of the present invention. A toggle link 30 with a pivot 32 has an end 34 on one side of the pivot 32 in contact with a compression spring 36 and another end 38 on the other side of pivot 32 in contact with an upper end 40 of the presser foot lifting bar 14. Upward movement of presser foot lifting bar 14 causes the upper end 40 thereof to urge end 38 of toggle link 30 upwardly and consequently end 34 downwardly thereby compressing spring 36. When presser foot lifting bar 14 ceases to be moved upwardly by shaft 20, crank 22 and links 22,24, spring 36 expands back to its original preloaded state thereby moving end 34 of toggle link 30 upwardly and consequently end 38 downwardly thereby moving lifting bar 14 and hence presser foot 12 back to the down position.

Use of toggle link 30 minimizes the spring 36 deflection keeping spring load more consistent and producing a faster return of the moment arm. Use of the toggle link 30 on a high lift sewing head will permit operational speeds up to 4000 rpm, and even greater speeds on lower lift feeding systems. Use of the toggle link 30 allows the spring 36 to operate within its 10%-20% compression range, which is optimum performance. Wear and fatigue of the machine's components are thus decreased.

Referring now to FIGS. 3, 3A and 3B, and again with like numbers designating like components, there is illustrated an alternative embodiment of a sewing machine 10*b* of the present invention. A support plate 42 has a toggle link 44 pivoted at 46. Toggle link 44 has an end 48 on one side of pivot 46 connected to a compression spring 50 supported on a spring guide 52 fixed to support plate 42 and another end 54 on the other side of pivot 46 connected to an upper end 56 of presser foot lifting bar 14. A pneumatic cylinder 58 is connected to support plate 42 at 60 and to a mounting plate 62 at 64. Support plate 42 is pivoted relative to mounting plate 62 also at 46.

Figure 3:
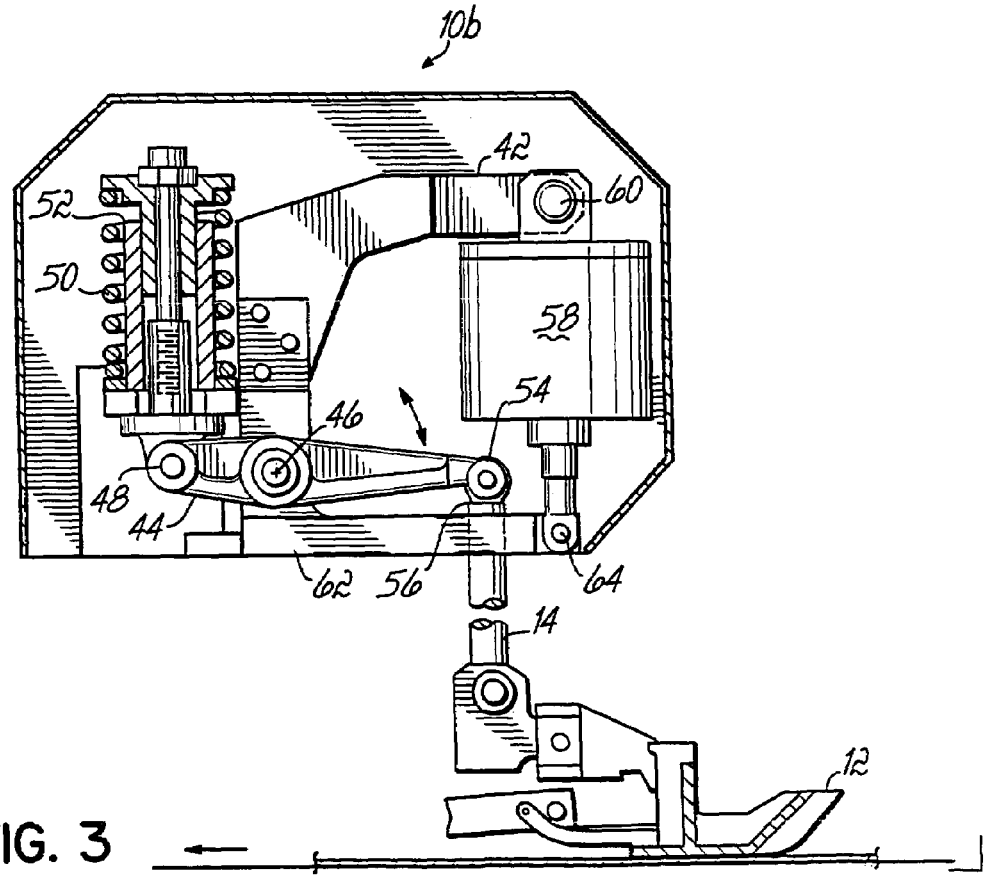
FIG. 3 is a partial side view of a sewing machine including another embodiment of presser foot biasing mechanism of the present invention.
Figure 3A:
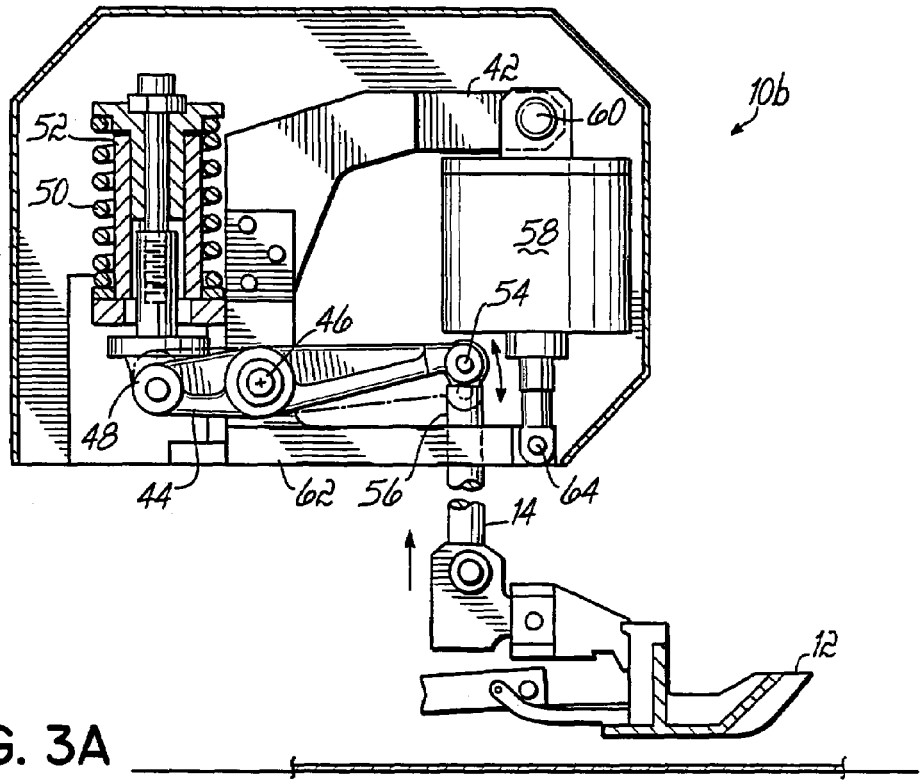
FIG. 3A is a view similar to FIG. 3 illustrating the travel of the presser foot lifting bar, toggle link and compression spring.
Figure 3B:
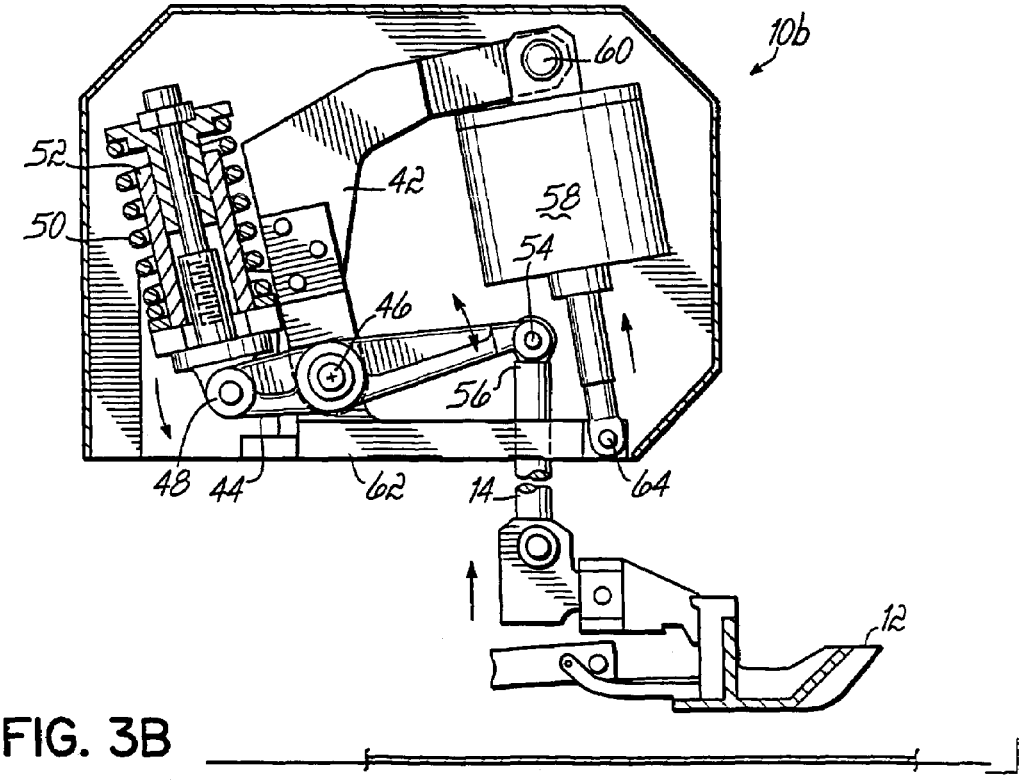
FIG. 3B is a view similar to FIG. 3 illustrating movement of the toggle link and compression spring into and out of biasing engagement with the presser foot lifting bar.

FIG. 3A illustrates the travel of presser foot 12, presser foot lifting bar 14, toggle link 44 and compression spring 50 during sewing. FIG. 3B illustrates the ability of the machine 10*b* to, via motion generated by pneumatic cylinder 58, move the toggle link 44 and compression spring 50 out of biasing engagement with the presser foot lifting bar 14.

In addition to the advantages discussed above in connection with the FIG. 2 embodiment, in the FIGS. 3, 3A and 3B embodiment manually activating the hydraulic or pneumatic cylinder (not shown) to raise the presser foot lifting bar avoids additional loading of spring 50 thereby further increasing its fatigue life, decreasing component wear, etc.

Those skilled in the art will readily recognize numerous adaptations and modifications which can be made to the present invention which will result in an improved sewing machine, yet all of which will fall within the spirit and scope of the present invention as defined in the following claims. Accordingly, the invention is to be limited only by the scope of the following claims and their equivalents.

What is claimed is:

1. A sewing machine comprising:

a presser foot;

a drive shaft operably connected to said presser foot which imparts periodic upward movement to said presser foot;

a biasing mechanism operably connected to said presser foot which normally biases said presser foot into a downward position, said biasing mechanism comprising a toggle link having a pivot, a resilient element operably connected to said toggle link on one side of said pivot and said presser foot operably connected to said toggle link on the other side of said pivot;

wherein said resilient element is a compression spring;

a presser foot lifting bar, said presser foot operably connected to said presser foot lifting bar; a mounting plate;

said toggle link operably pivoted relative to said mounting plate;

said resilient element operably fixed relative to said mounting plate;

said toggle link operably connected to said presser foot lifting bar;

a support plate, said toggle link pivoted to said support plate and said resilient element fixed to said support plate;

said support plate pivoted to said mounting plate;

whereby pivoting said support plate relative to said mounting plate pivots said toggle link and resilient element out of biasing engagement with said presser foot lifting bar.

2. The sewing machine of claim 1 further comprising:

a motion generating device operably connected between said support plate and said mounting plate for pivoting said support plate, toggle link and resilient element into and out of biasing engagement with said presser foot lifting bar.

3. The sewing machine of claim 2 wherein said motion generating device is a pneumatic cylinder.

4. A sewing machine comprising:

a presser foot;

a drive shaft operably connected to said presser foot which imparts periodic upward movement to said presser foot; and a biasing mechanism operably connected to said presser foot which normally biases said presser foot into a downward position, said biasing mechanism having a preload force therein when said presser foot is in a lowermost position;

said presser foot being selectively raisable without increasing the preload force of said biasing mechanism;

wherein said biasing mechanism is selectively pivotable into and out of biasing engagement with said presser foot thereby preventing any increase in the biasing mechanism preload force during selective raising of said pressure foot.

5. The sewing machine of claim 4 wherein said biasing mechanism comprises:

a compression spring; and a toggle link;

said compression spring operably connected to one end of said toggle link, said presser foot operably connected to the other end of said toggle link.

6. The sewing machine of claim 5 further comprising:

a mounting plate;

a support plate pivoted to said mounting plate;

said compression spring fixed to said support plate;

said toggle link pivoted to said support plate.

7. The sewing machine of claim 5 further comprising a presser foot lifting bar, said presser foot connected to one end of said presser foot lifting bar, said toggle link connected to the other end of said presser foot lifting bar.

8. A sewing machine comprising:

a presser foot;

a drive shaft operably connected to said presser foot which imparts periodic upward movement to said presser foot; and a biasing mechanism operably connected to said presser foot which normally biases said presser foot into a downward position, said biasing mechanism having a preload force therein when said presser foot is in a lowermost position;

said presser foot being selectively raisable without increasing the preload force of said biasing mechanism;

wherein said biasing mechanism is selectively movable into and out of biasing engagement with said presser foot thereby preventing any increase in the biasing mechanism preload force during selective raising of said pressure foot.

* * * * *

UNITED STATES PATENT AND TRADEMARK OFFICE

CERTIFICATE OF CORRECTION

PATENT NO. : 7,360,497 B2
APPLICATION NO. : 10/841501
DATED : April 22, 2008
INVENTOR(S) : Steven Marcangelo et al.

It is certified that error appears in the above-identified patent and that said Letters Patent is hereby corrected as shown below:

Column 2

Line 22, “pressure” should be --presser--.

Line 63, delete the period (.) after “foot”.

Column 4

Line 48, “pressure” should be --presser--.

Column 6

Line 7, “pressure” should be --presser--.

Signed and Sealed this

Thirtieth Day of December, 2008

JON W. DUDAS
*Director of the United States Patent and Trademark Office*